US005523772A

United States Patent [19]

Lee

[11] Patent Number: 5,523,772

[45] Date of Patent: Jun. 4, 1996

[54] SOURCE DRIVING DEVICE OF A LIQUID CRYSTAL DISPLAY

[75] Inventor: Dae-Won Lee, Kyungki-do, Rep. of Korea

[73] Assignee: Samsung Electronics Co., Ltd., Suwon, Rep. of Korea

[21] Appl. No.: 238,854

[22] Filed: May 6, 1994

[30] Foreign Application Priority Data

May 7, 1993 [KR] Rep. of Korea ..... 93-7857

[51] Int. Cl.[6] ..... G09G 3/36

[52] U.S. Cl. ..... 345/98; 345/100

[58] Field of Search ..... 345/87, 98, 100, 345/88, 89, 99; 359/54, 55; 348/790; H04N 3/14

[56] References Cited

U.S. PATENT DOCUMENTS

| | | | |
|---|---|---|---|
| 5,168,270 | 12/1992 | Masumori | 345/100 |
| 5,192,945 | 3/1993 | Kusada | 345/100 |
| 5,283,565 | 2/1994 | Suzuki | 345/98 |
| 5,313,222 | 5/1994 | Lee | 345/100 |
| 5,335,023 | 8/1994 | Edwards | 345/100 |
| 5,337,070 | 8/1994 | Kitajima | 345/98 |
| 5,357,290 | 10/1994 | Horibe | 345/100 |

FOREIGN PATENT DOCUMENTS

| | | | |
|---|---|---|---|
| 0391654 | 10/1990 | European Pat. Off. | 345/98 |
| 0458349A2 | 11/1991 | European Pat. Off. | 345/98 |
| WO90/07768 | 7/1990 | WIPO | 345/100 |

*Primary Examiner*—Richard Hjerpe
*Assistant Examiner*—Xiao M. Wu
*Attorney, Agent, or Firm*—Cushman Darby & Cushman

[57] ABSTRACT

A source driving device for a liquid crystal display which includes a mode conversion switch for selecting between a digital-to-analog of operation for applications requiring eight grey levels, and an analog-to-analog mode of operation for applications requiring more than eight grey levels. The source driver includes a shift register for sequentially enabling portions of stored image data to be processed in the digital-to-analog mode. The source driver also includes a sample and hold circuit for providing a regulated output of an analog image signal in the analog-to-analog.

12 Claims, 4 Drawing Sheets

SOURCE DRIVING DEVICE OF A LIQUID CRYSTAL DISPLAY

BACKGROUND OF THE INVENTION

1. Field of the Invention

The present invention relates to a source driving circuit for a liquid crystal display.

2. Description of the Related Art

Liquid crystal display devices are commonly used in computer monitors, televisions, and view finders. Such devices are typically manufactured by disposing liquid crystal material between a first substrate having a matrix of pixel electrodes and a second substrate having color filters. Source and data driving devices are usually provided in the form of a peripheral circuit. A source driving device may be a digital-to-analog (D/A) converter driver or an analog-to-analog (A/A) driver.

In liquid crystal display devices used in personal computer monitors, especially in multi-media applications, it is difficult to provide images requiring more than 64 grey levels using a D/A driver. A D/A converter devicer in a typical source driver receives n bus lines and can generate $2^n$ grey levels. As a practical matter, a source driver is limited to providing eight grey levels, since analog switches occupy a large amount of chip area and require relatively large controlling voltages.

It has been proposed to use two eight-grey level source driving devices for a liquid crystal display, in order to provide 64 grey levels. Such a device is shown in FIG. 1. Digital image data on data lines $D_0$–$D_5$ are provided to two 3×8 decoders, which operate to select two lines (in this example, lines $V_3$ and $V_5$). The average voltage level of the two lines is determined to produce one of 64 grey levels. However, in such an arrangement, there are discontinuities in the voltage distribution between grey levels.

SUMMARY OF THE INVENTION

The present invention provides for a source driver for a liquid crystal display that occupies minimal chip area, operates in both a D/A converting driving mode and an A/A converting driving mode to display an unlimited number of grey levels, and eliminates discontinuities in the distribution of grey voltage levels.

Specifically, the source driving device of the present invention includes a mode conversion switch for selecting a digital-to-analog (D/A) mode or an analog-to-analog (A/A) digital mode in response to a mode select signal. In the D/A mode, image data is temporarily stored in a data memory and portions of the stored data are sequentially enabled in response to the output of a shift register. A decoder receives and decodes input image data and outputs a control signal to a level shifter circuit. The control signal causes one of a plurality of voltage levels to be output by the source driver in the D/A mode. In the A/A mode, an enable signal generator enables a sample/hold circuit, which samples and holds an analog color signal and outputs a source driving signal.

DETAILED DESCRIPTION OF PRESENTLY PREFERRED EMBODIMENTS

Figure 1A:
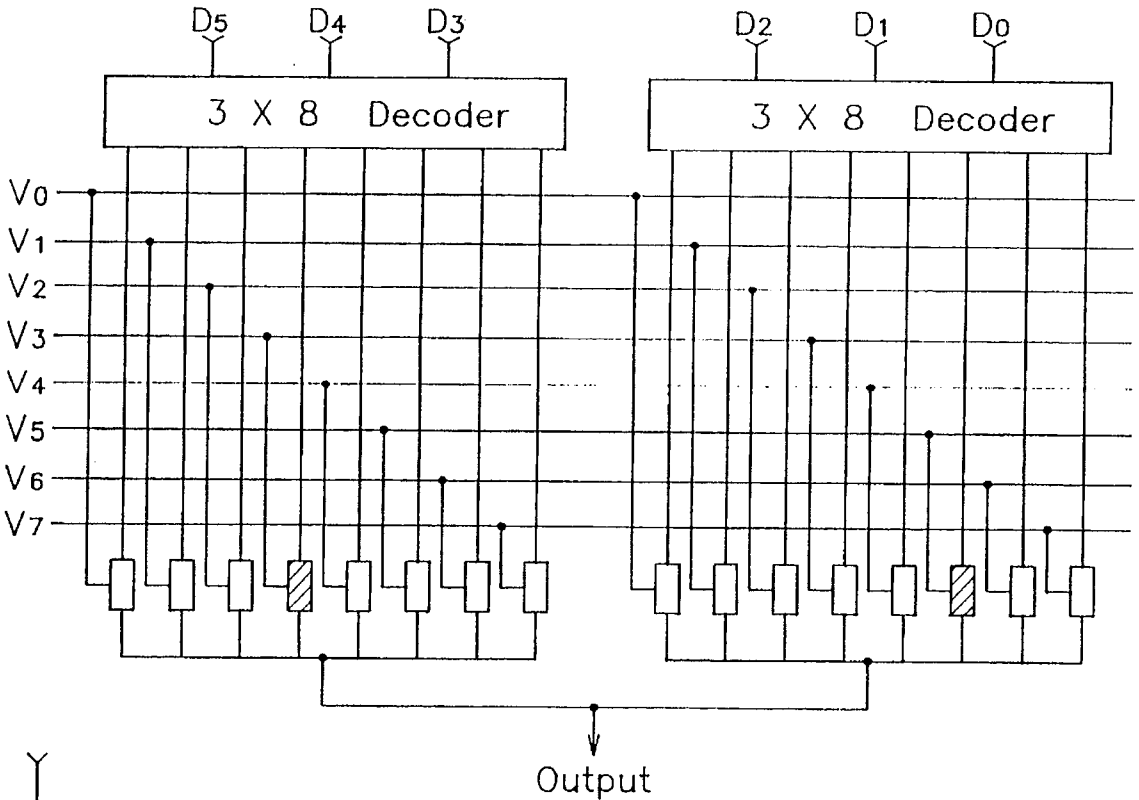
FIG. 1A and 1B are a circuit diagram of a grey level voltage generator for driving a conventional liquid crystal display.
Figure 1B:
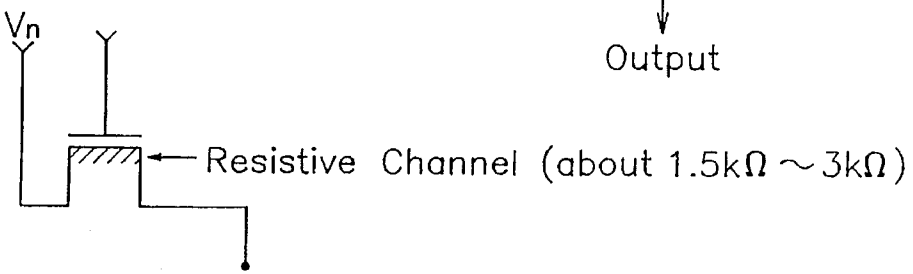
FIG. 1B (PRIOR ART)
Figure 2:
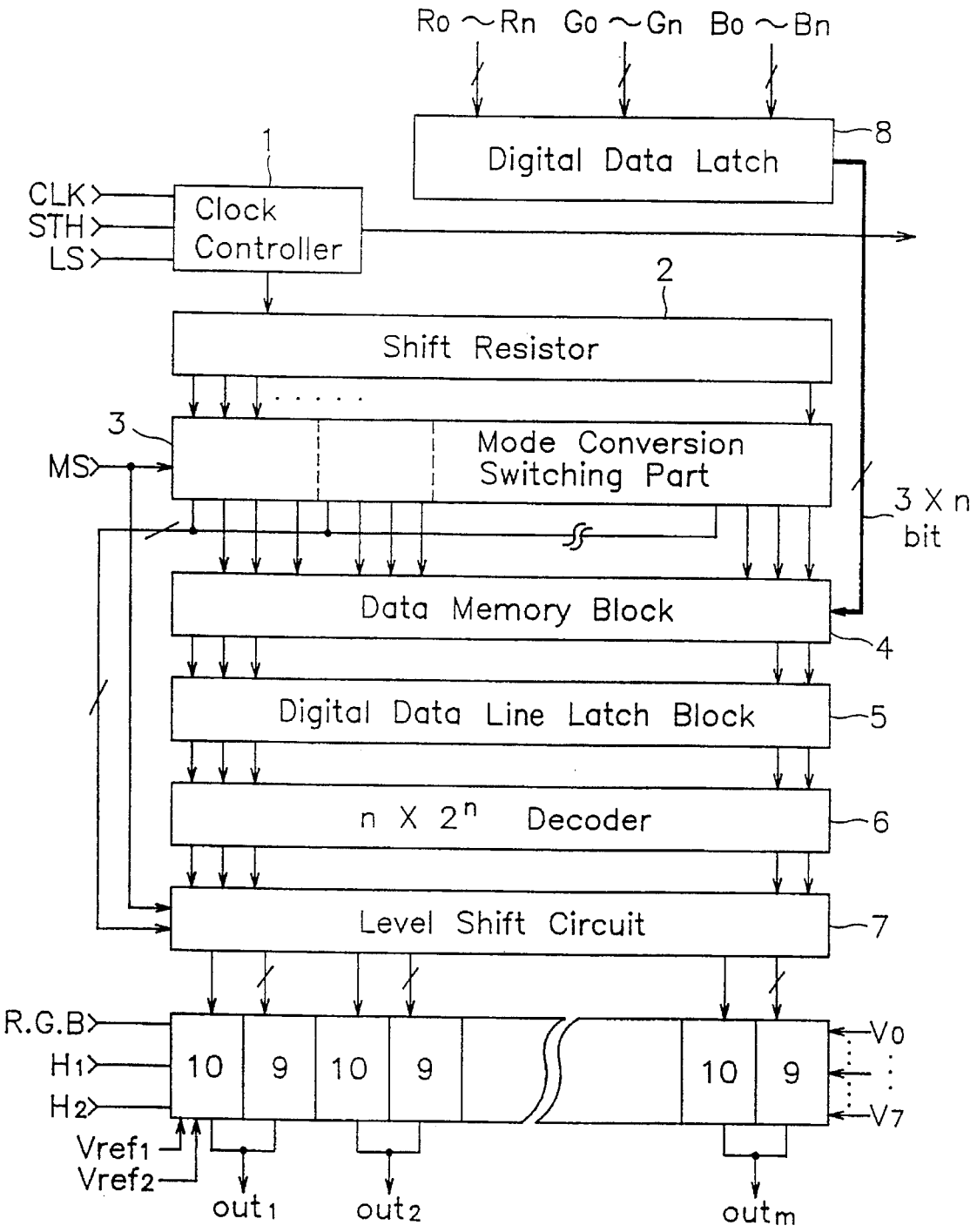
FIG. 2 is a block diagram of a driving device for a liquid crystal display in accordance with the present invention.

Referring now to FIG. 2, a driving device for a liquid crystal display in accordance with the present invention is shown. A digital data latch 8 receives and temporarily stores color image data signals on lines RO-Rn (red), GO-Gn (green), and BO-Bn (blue). The data is then supplied to data memory block 4 and stored for subsequent signal processing. Data memory block 4 stores the image data at a predetermined location, and outputs specified image data in response to the enable signal generated by shift register 2. A mode conversion switch 3 is disposed between the shift register 2 and data memory block 4 and selects either a D/A converting driving mode or an A/A converting driving mode.

Figure 3:
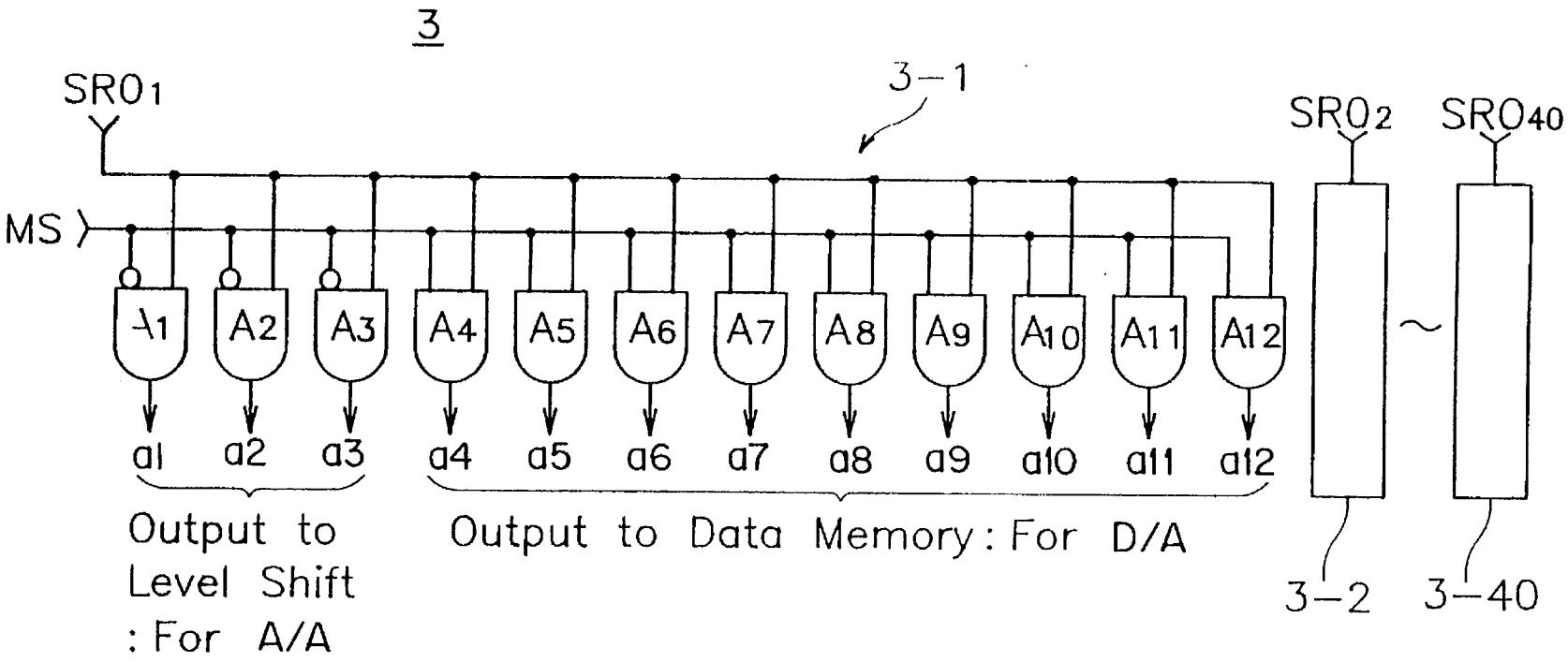
FIG. 3 is a detailed circuit diagram of the mode selecting switch shown in FIG. 2.

Referring now to FIG. 3, a diagram of the mode conversion switch 3 is shown. The mode conversion switch 3 receives a mode select signal MS that determines whether the driver operates in the D/A mode or A/A mode. The mode conversion switch 3 also receives the output of shift register 2. In this example, shift register 2 has 40 cells SRO1–SRO40, which are sequentially activated according to a clock signal. The output of SRO1 is provided to a first unit block 3-1 of mode conversion switch 3, the output of SRO2 is provided to a second unit block 3-2 of mode conversion switch 3, etc. The mode conversion switch 3 has 40 unit blocks 3-1 to 3-40, corresponding to the register cells of shift register 2. Each unit block includes 12 AND gates. AND gates A1–A12 of unit block 3-1 are shown by way of example in FIG. 3.

AND gates A1–A12 each have a first input connected to the output of SRO1, the shift register cell associated with unit block 3-1. AND gates A1–A12 each also have a second input connected to the line carrying mode select signal MS. The mode select signal is inverted at the inputs to AND gates A1–A3, such that AND gates A4–A12 are selected during the D/A converting driving mode, and AND gates A1–A3 are selected during the A/A converting driving mode.

In the A/A converting driving mode, gates A1–A3 of each block unit within mode conversion switch 3 illustrated in FIG. 3 provide outputs a1–a3 to level shift circuit 7, shown in FIG. 2. In the D/A converting driving mode, gates A4–A12 of each block unit within mode conversion switch 3 illustrated in FIG. 3 provide outputs to the data memory block 4, shown in FIG. 2, in order to enable the transfer of a portion of the image data stored in data memory block 4. Nine AND gates A4–A12 are used because each image data signal of red, green, and blue is three bits.

The D/A mode is selected for applications requiring eight grey levels, and will now be described. Referring again to FIG. 2, a driver clock signal is generated by clock controller 1 in response to a main clock CLK, a starting horizontal signal STH, and a loading signal LS. The starting horizontal signal STH indicates that a first color data has been input to the data memory block 4. Loading signal LS is used for moving color data stored in data memory block 4 by enabling digital data line latch 5. Shift register 2 ensures that each memory device in data memory block 4 is enabled sequentially according to the driver clock signal. It will be appreciated that data memory block 4 should have sufficient input terminals to accept the output of each cell of shift register 2.

If digital data line latch 5 is enabled by loading signal LS, the data stored in data memory block 4 is latched and then provided to $\times 2^2$ decoder 6. The output of decoder 6 is provided to level shift circuit 7, which is described in further detail with reference to FIG. 4. Decoder 6 receives a 3-bit color data signal and, via the level shifter circuit 7, enables one of eight transmission gates TG1–TG8. For example, if decoder 6 enables transmission gate TG4, an enabling signal turns on MOS transistor M4 of voltage selector 9 via a buffer B3. Accordingly, a voltage V3 is provided to output terminal P.

Figure 4:
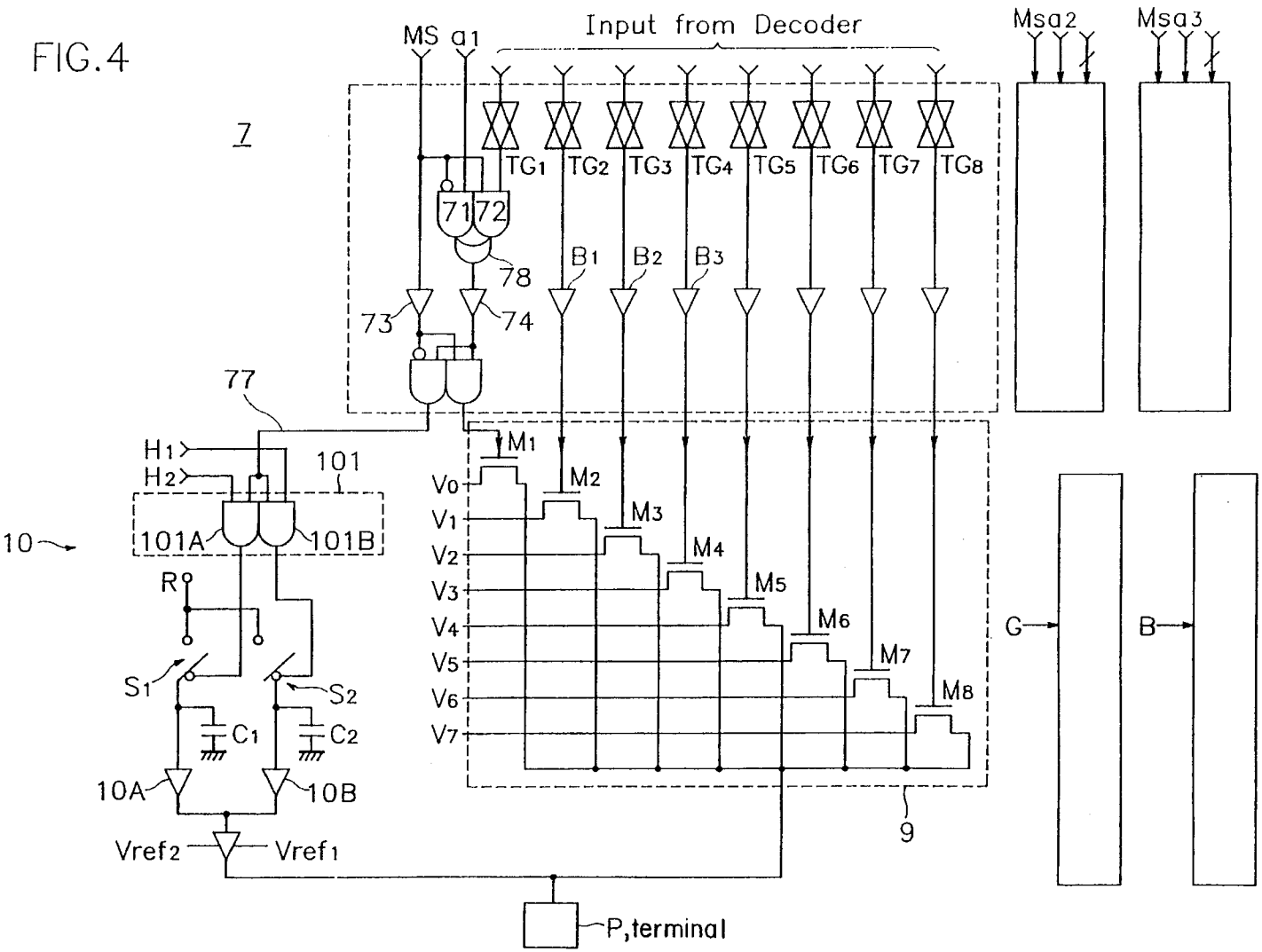
FIG. 4 is a detailed circuit diagram of a level shifting circuit, voltage selector, and a sample/hold circuit.

One block of level shift circuit 7 is shown in detail in FIG. 4 and is shown illustratively as processing a red signal. Three such blocks, one each for red, green, and blue signals, are provided in each of 40 processing units in level shift circuit 7. Thus, in this example, 120 channels are provided by the source driver of the present invention to achieve an eight-grey level image display.

The A/A converting driving method is selected for applications requiring more than 8 grey levels. To select the A/A converting driving method, the logic level of mode select signal MS is changed such that the first three AND gates in each block of mode conversion switch 3, for example AND gates A1–A3, are enabled. The outputs of AND gates A1–A3, for example, outputs a1–a3, are applied to level shift circuit 7. The output signals such as a1–a3 indicate red, green, or blue, respectively, and act as control signals for the blocks of the processing units of level shift circuit 7. In this example, a1 is a control signal for the red block of level shift circuit 7, as shown in FIG. 4.

Control signal a1 and mode select signal MS are applied to an enabling circuit for enabling a sample/hold circuit. The enabling circuit includes AND gates 71 and 72, each of which receives mode select signal MS and control signal a1 as inputs, and provides an output to OR gate 78. The mode select signal MS is inverted at the input to AND gate 71. Mode select signal MS is also applied to AND gates 75 and 76. The mode select signal MS is inverted at the input to AND gate 75. In this arrangement, when mode select signal MS is at a logic low level, indicating the A/A converting driving method, OR gate 78 outputs a logic high level, and AND gate 75 outputs a logic high A/A mode enable signal on line 77.

The enable signal on line 77 enables a sample and hold circuit 10 to sample and hold an analog color signal, a red signal R in this example. The red signal R is output via terminal P. The logic high enable signal on line 77 is applied to the first inputs of AND gates 101A and 101B of the sampling control switch 101. The second inputs of AND gates 101A and 101B receive sample/hold switching signals H2 and H1, respectively. The outputs of AND gates 101A and 101B control the operation of switches S1 and S2.

When switches S1 and S2 are closed, analog color signal R charges capacitors C1 and C2, and the output at terminal P is regulated by buffers 10A and 10B and an operational amplifier, which receives the buffered analog color signal R and reference voltages Vref1 and Vref2 as inputs.

The present invention accordingly provides for digital signal processing and analog signal processing in a source driver for a liquid crystal display. The present invention enables the display of more than 64 levels of grey without requiring a large chip area or an increased number of input terminals. The present invention also allows direct processing of image data without the use of an analog-to-digital converter.

While this invention has been described in connection with what is presently considered to be the most practical and preferred embodiments, it is to be understood that the invention is not limited to the disclosed embodiments. Rather, various modifications will be apparent to one of skill in the art which do not depart from the spirit and scope of the invention, as defined by the appended claims and their equivalents.

What is claimed is:

1. A source driving device for a liquid crystal display comprising:

a data memory for storing image data;

a mode conversion switch for selecting one of a digital-to-analog mode of operation and an analog-to-analog mode of operation in response to a mode select signal;

a shift register for sequentially enabling portions of said stored image data to be processed in said digital-to-analog mode of operation in response to a clock signal, said shift register including a plurality of register cells;

a decoder for decoding each of said portions of said stored data in said digital-to-analog mode of operation and providing a decoder output signal;

voltage supply means for supplying one of a plurality of voltages to an output terminal in response to said decoder output signal in said digital-to-analog mode of operation;

a sample and hold circuit sampling and holding an analog color signal and supplying a source driving signal to said output terminal; and an enable signal generator for enabling said sample and hold circuit in said analog-to-analog mode in response to a control signal generated by said mode conversion switch.

2. The source driving device of claim 1, wherein said voltage supply means includes a level shift circuit for transmitting said decoder output signal to one of a plurality of transmission lines, each of said plurality of transmission lines including a transmission gate and a buffer.

3. The source driving device of claim 1, wherein said mode conversion switch includes a plurality of blocks, each block corresponding to one of said plurality of register cells and each block including a plurality of AND logic gates.

4. The source driving device of claim 3, wherein said plurality of AND logic gates includes:

a first set of AND logic gates which outputs said control signal in said analog-to-analog model; and a second set of AND logic gates which outputs contents of a corresponding one of said plurality of register cells to enable said portions of said stored image data to be processed.

5. The source driving device of claim 3, wherein each of said plurality of AND logic gates receives an output of one of said plurality of register cells as a first input and receives said mode select signal as a second input.

6. The source driving device of claim 5, wherein said plurality of AND logic gates includes:

a first set of AND logic gates which outputs said control signal in said analog-to-analog mode; and a second set of AND logic gates which outputs contents of a corresponding one of said plurality of register cells to enable said portions of said stored image data to be processed.

7. A source driving device for a liquid crystal display comprising:

data memory means for storing image data;

mode conversion switching means for selecting one of a digital-to-analog mode of operation and an analog-to-analog mode of operation in response to a mode select signal;

shift register means for sequentially enabling portions of said stored image data to be processed in said digital-to-analog mode of operation in response to a clock signal, said shift register means including a plurality of register cells;

decoder means for decoding each of said portions of said stored data in said digital-to-analog mode of operation and providing a decoder output signal;

voltage supply means for supplying one of a plurality of voltages to an output terminal in response to said decoder output signal in said digital-to-analog mode of operation;

sample and hold means for sampling and holding an analog color signal and supplying a source driving signal to said output terminal; and enable signal generator means for enabling said sample and hold circuit in said analog-to-analog mode in response to a control signal generated by said mode conversion switching means.

8. The source driving device of claim 7, wherein said voltage supply means includes a level shifting means for transmitting said decoder output signal to one of a plurality of transmission lines, each of said plurality of transmission lines including a transmission gate and a buffer.

9. The source driving device of claim 7, wherein said mode conversion switching means includes a plurality blocks, each block corresponding to one of said plurality of register cells and each block including a plurality of AND logic gates.

10. The source driving device of claim 9, wherein each of said plurality of AND logic gates receive an output of one of said plurality of register cells as a first input and receive said mode select signal as a second input.

11. The source driving device of claim 10, wherein said plurality of AND logic gates includes:

a first set of AND logic gates which outputs said control signal in said analog-to-analog mode; and a second set of AND logic gates which outputs contents of a corresponding one of said plurality of register cells to enable said portions of said stored image data to be processed.

12. A source driving device for a liquid crystal display comprising:

a data memory for storing image data;

a mode conversion switch for selecting one of a digital-to-analog mode of operation and an analog-to-analog mode of operation in response to a mode select signal;

a shift register for sequentially enabling portions of said stored image data to be processed in said digital-to-analog mode of operation in response to a clock signal, said shift register including a plurality of register cells;

a decoder for decoding each of said portions of said stored data in said digital-to-analog mode of operation and providing a decoder output signal;

a voltage supply for supplying one of a plurality of voltages to an output terminal in response to said decoder output signal in said digital-to-analog mode of operation;

a sample and hold circuit sampling and holding an analog color signal and supplying a source driving signal to said output terminal; and an enable signal generator for enabling said sample and hold circuit in said analog-to-analog mode in response to a control signal generated by said mode conversion switch.

* * * * *